US005701696A

United States Patent [19]

Clontz

[11] Patent Number: 5,701,696

[45] Date of Patent: Dec. 30, 1997

[54] CARD HOLDER

[76] Inventor: Richard C. Clontz, 4 High Pine Ct., Cockeysville, Md. 21030

[21] Appl. No.: 476,107

[22] Filed: Jun. 7, 1995

[51] Int. Cl.[6] ..... G09F 3/18

[52] U.S. Cl. ..... 40/642.02; 40/492; 273/296; 273/430; 434/331; 434/348

[58] Field of Search ..... 40/486, 492, 642.02, 40/649, 729, 730, 733, 661.06, 661.07; 273/148 A, 296, 429, 430, 431, 432; 434/327, 331, 348; 446/487

[56] References Cited

U.S. PATENT DOCUMENTS

| | | | |
|---|---|---|---|
| 1,868,823 | 7/1932 | Goodrich . | |
| 2,310,711 | 2/1943 | Savage . | |
| 2,809,467 | 10/1957 | St. Pierre et al. . | |
| 2,971,268 | 2/1961 | Zimmerman . | |
| 3,097,435 | 7/1963 | Goldschmidt . | |
| 3,248,050 | 4/1966 | Dickson | 434/331 X |
| 3,359,651 | 12/1967 | Mair . | |
| 3,530,614 | 9/1970 | Strongin . | |
| 3,780,451 | 12/1973 | White . | |
| 4,095,366 | 6/1978 | Buck et al. . | |
| 4,095,783 | 6/1978 | Bailey . | |
| 4,183,166 | 1/1980 | Borner . | |
| 4,657,248 | 4/1987 | Benaim . | |

OTHER PUBLICATIONS

Prior Use of a "Gentleman's Wallet" Novelty Item.

*Primary Examiner*—Brian K. Green

[57] ABSTRACT

A card holder having a pair of plates movably coupled together by a series a straps for displaying and playing with cards. The plates include openings into which the cards are received. The straps overlie one face of each of the plates so as to cover selected portions of the cards. The set of straps on one plate are vertically staggered with respect to the set of straps on the other plate. The straps and plates are uniquely interconnected to effect a reversal of the straps upon manipulation of the plates.

20 Claims, 5 Drawing Sheets

CARD HOLDER

FIELD OF THE INVENTION

The present invention pertains to a card holder capable of displaying cards and facilitating game playing, especially with cards having pictures of sport, cartoon, or other famous personalities.

BACKGROUND OF THE INVENTION

Collecting cards of various kinds, and especially sport cards, has become a popular past time for all ages, and particularly for youths. However, since the cards are composed primarily of paper or cardboard, they are easily bent or damaged. Damaged cards not only reduce the collector's enjoyment of the cards, but also their resale value.

Plastic transparent covers have been used in an effort to protect the cards. The covers may be in the form of an envelope adapted to receive a single card, or as a sheet provided with rows of pockets for receiving a plurality of cards. The sheets, in turn, may be secured in binders in much the same way as a photo album. Although greater protection of the cards is afforded by these covers, the cards cannot be supported for easy display. Moreover, while in the covers, the cards have no play value beyond merely viewing. Though the cards may be removed from the covers to facilitate play, such removal subjects the cards to a much greater risk of being damaged.

Sport cards and the like typically include a picture of a particular personality (e.g., an athlete) on the front side, and facts (e.g., statistics) about the individual on the back side. As can be appreciated, such cards provide no educational benefit to the collector, except for, perhaps, general memorization of the printed facts. Since conventional covers merely encase the card for protection, receipt of the cards into the covers likewise fail to provide the collector with an educational benefit.

While there are devices which are adapted to receive cards to facilitate the playing of a game, the devices are inapposite to sport cards and the like. For example, U.S. Pat. No. 4,657,248 to Benaim discloses a device which is adapted to receive specialty cards for a question and answer game. The device receives cards and uncovers different portions of the received cards at different points during the game. The Benaim device, however, is not suitable to receive sport cards and the like for display or game playing.

SUMMARY OF THE INVENTION

The present invention pertains to a card holder having a pair of plates movably coupled together by a plurality of straps. A sport card or the like is mounted to at least one of the plates so that both faces of the card can be viewed. The straps overlie the rear faces of the plates such that straps overlying one plate are offset from straps overlying the other plate. The straps and plates are interconnected to enable a reorientation of the straps from one plate to the other upon manipulation of the plates. In this way, selected portions of the card can be obstructed to facilitate game playing with the cards.

With the present invention, cards mounted to the plates can be effectively displayed for viewing of each face. In addition, manipulation of the plates and reorientation of the straps facilitate playing with the cards. Specifically, such manipulation causes the straps to alternatingly cover questions and answers for playing a game. Moreover, manipulation of the plates offers further amusement by creating an optical illusion that the cards are being flipped.

DETAILED DESCRIPTION OF THE PREFERRED EMBODIMENTS

Figure 1:
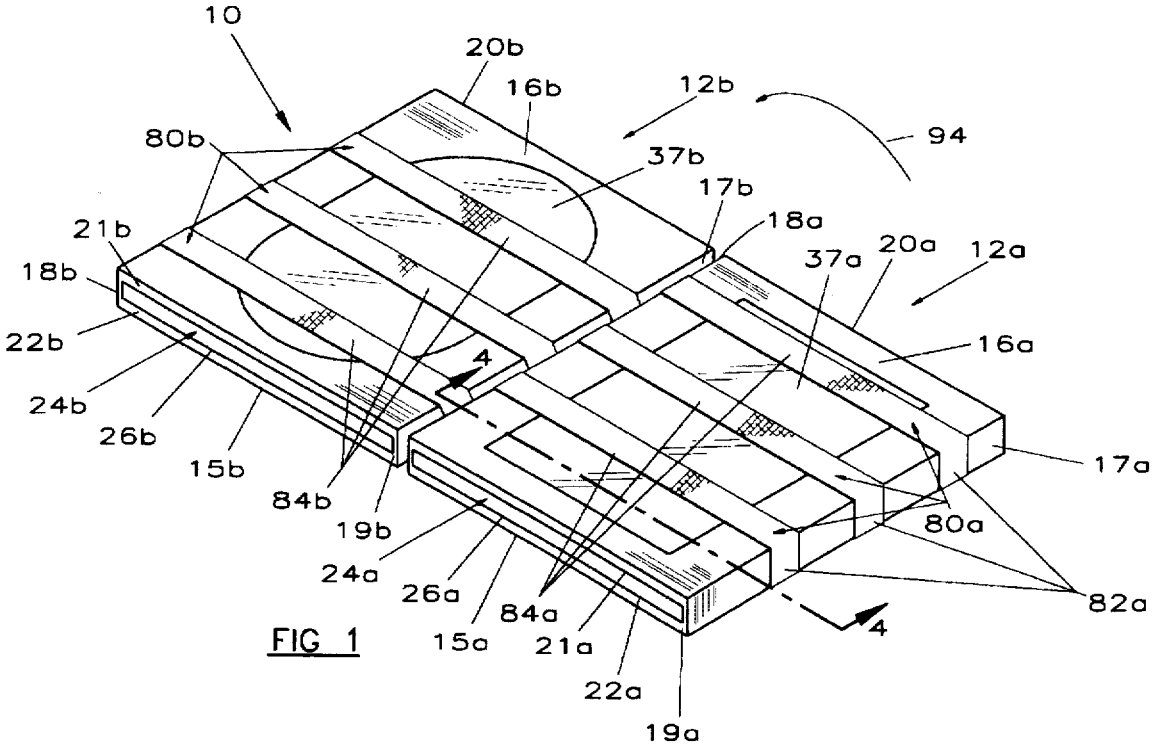
FIG. 1 is a perspective view of a card holder in accordance with the present invention arranged in a first position.

A card holder 10 in accordance with the present invention includes a pair of plates 12*a*, 12*b* (FIGS. 1–5 and 7). The plates as shown are provided with different configurations in order to more easily follow the movements of the plates. Nevertheless, the plates are preferably identical to each other.

Each plate 12 has a front face 15, a rear face 16, a first side edge 17, a second side edge 18, a top edge 19, and a bottom edge 20. While the plates are preferably rectangular, they could be formed with other shapes as desired. In particular, top and side edges 17–19 could be formed to have virtually any shape. Bottom edge 20 is preferably a flat surface to enable the plate to be free standing and provide a suitable display for the cards. Of course, bottom edge 20 could have other shapes so long as the stability and support needed to enable the plates to stand is provided. Plates 12 are preferably composed of an opaque plastic material, but could be made of a transparent plastic material or other materials, such as wood, metal, ceramic, etc.

Unlike conventional playing cards, sport cards and the like are provided with unique material on each of the two faces 33, 34. Front face 33 of card 25 includes a picture (e.g., of a famous individual), an illustration, a hologram, or virtually any other illustration or indicia. Rear face 34 of card 25 includes at least one question 90 and an answer 91 to the question, and preferably a series of questions and answers. The questions could be trivial, educational or of any other nature. As an example, educational questions could require a collector to compute a baseball player's batting average or to sum a series of numbers to calculate a number of home runs that were hit in a particular year. Rear face 34 could also be provided with pictures, illustrations, or various facts (e.g., statistics of a sports personality).

In the preferred embodiment, plate 12*a* is further provided with an elongate opening or slot 24*a* for receiving a card 25 (FIGS. 1–4). The slot is defined by a front wall 21*a* and a rear wall 22a along each of its opposite sides and extends longitudinally through most of the plate. Slot 24a preferably has an open end 26a along top edge 19a. However, the open end of the slot could be formed in one of the other edges 17, 18, 20 if desired. Front and rear walls 21a, 22a are each provided with a central hole 28a, 29a such that walls 21a, 22a are formed as marginal borders about the holes. Holes 28a, 29a are aligned with each other such that a central opening passes entirely through plate 12a when card 25 is removed. The holes, therefore, permit one to see both faces 33, 34 of the card received into slot 24a. Front face 33 of card 25 is visible through opening 28a, and rear face 34 of card 25 is visible through opening 29a.

Figure 2:
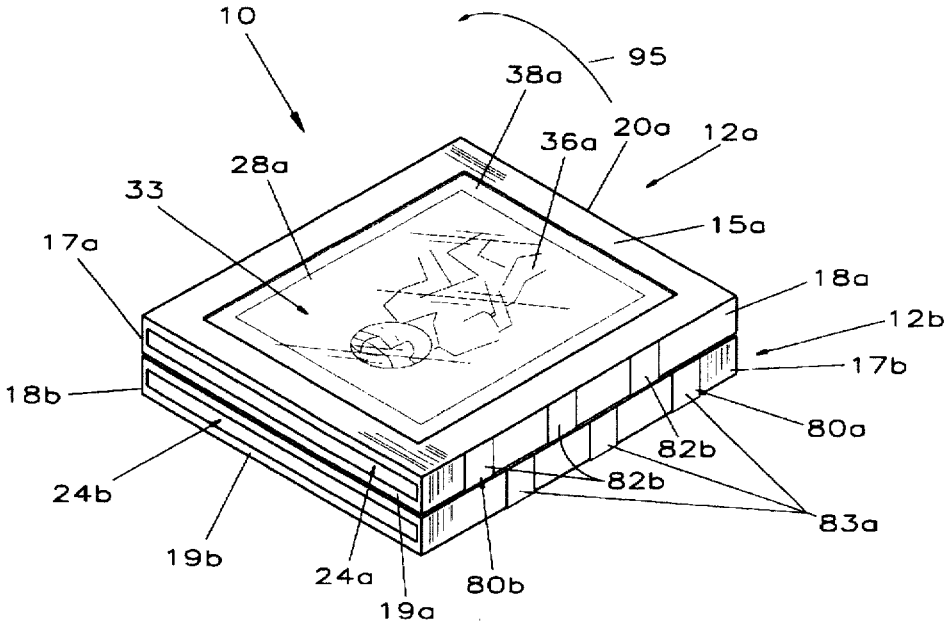
FIG. 2 is a perspective view of the card holder arranged in a second position.
Figure 3:
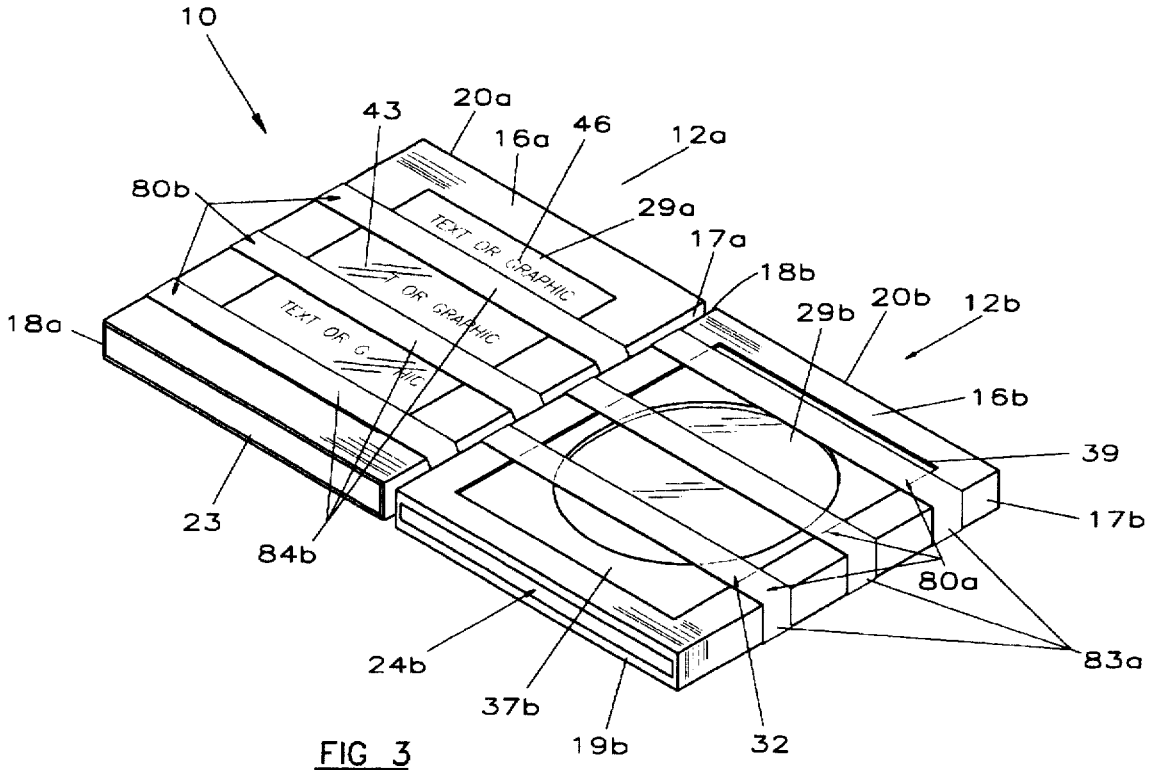
FIG. 3 is a perspective view of the card holder arranged in a third position.
Figure 4:
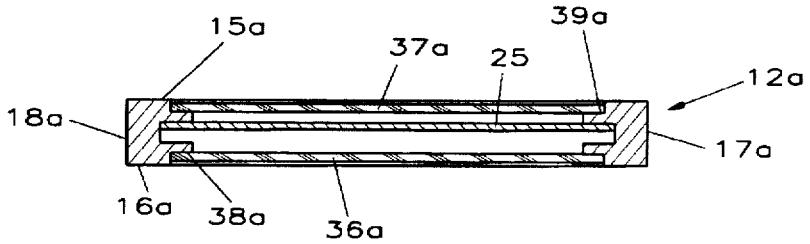
FIG. 4 is a cross-sectional view taken along line 4—4 in FIG. 1.
Figure 5:
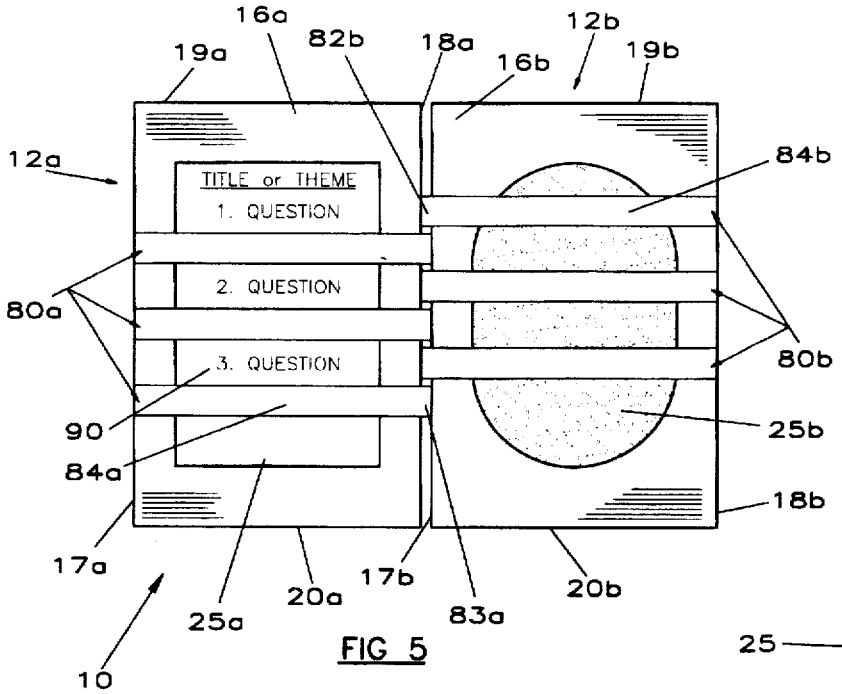
FIG. 5 is a plan view of the rear face of the card holder.
Figure 6:
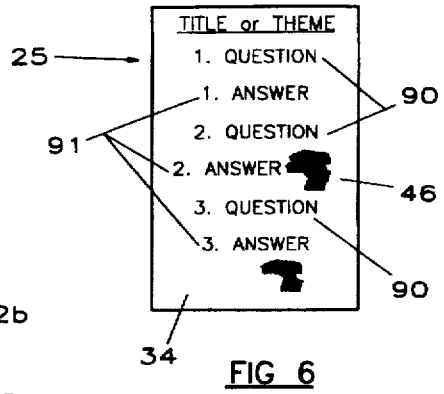
FIG. 6 is a plan view of the rear face of a card adapted for receipt into the card holder.
Figure 7:
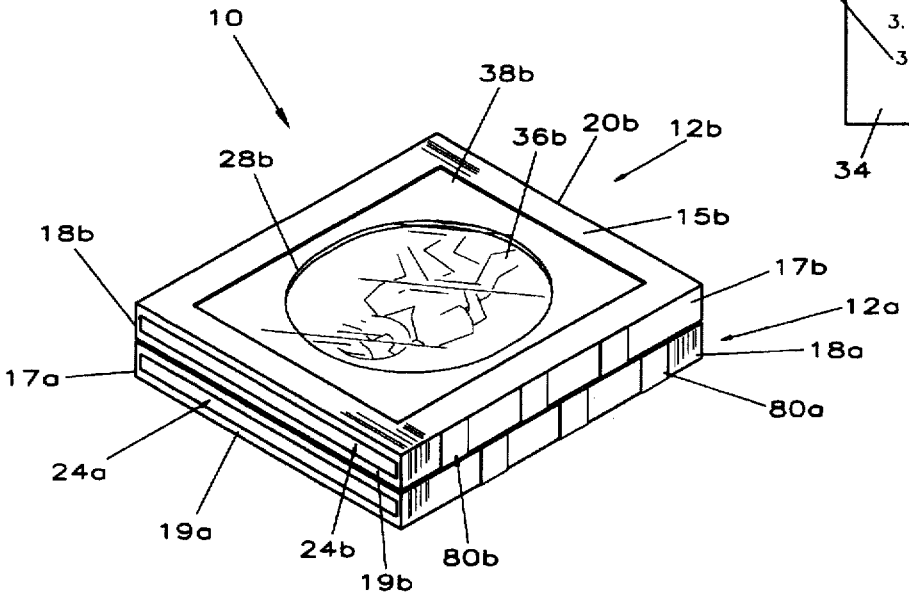
FIG. 7 is a front perspective view of the card holder in an inverted second position.
Figure 8:
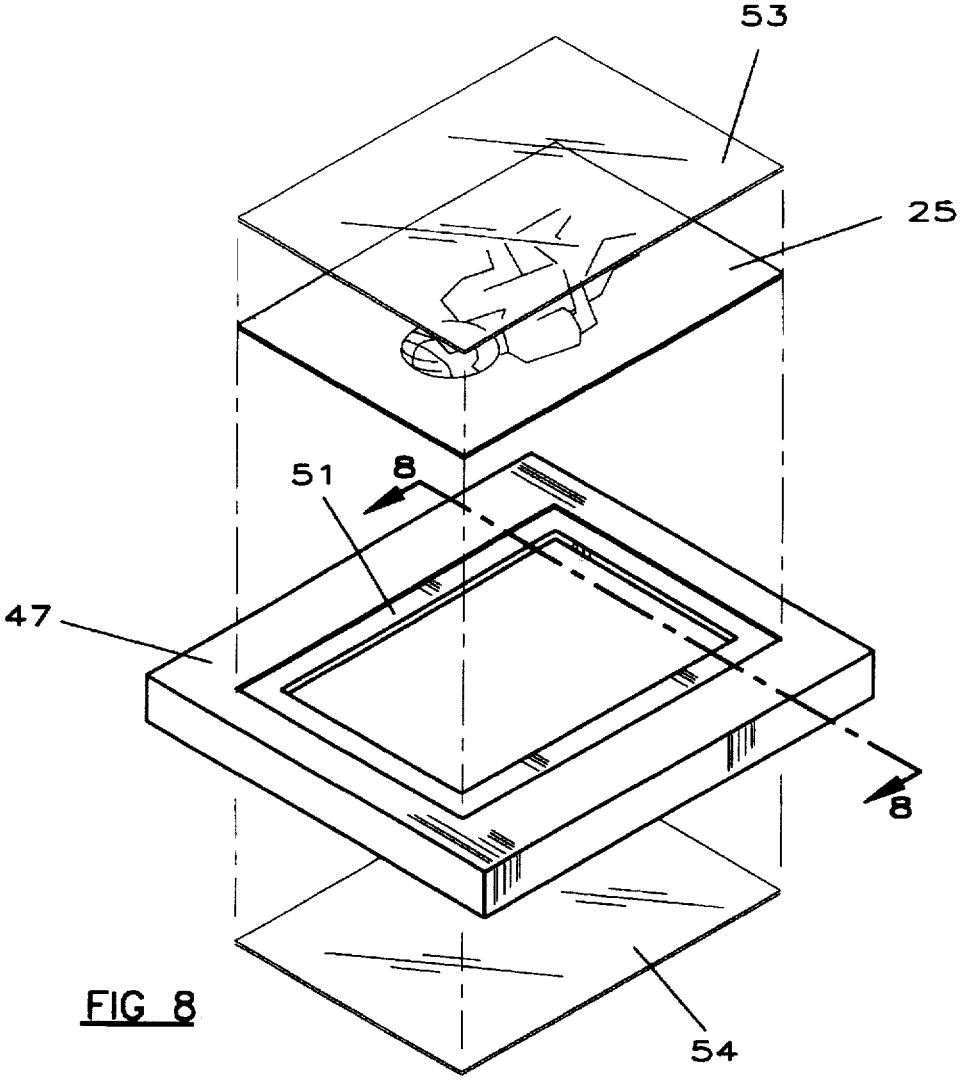
FIG. 8 is an exploded view of one plate of a another embodiment of a card holder in accordance with the present invention.
Figure 9:
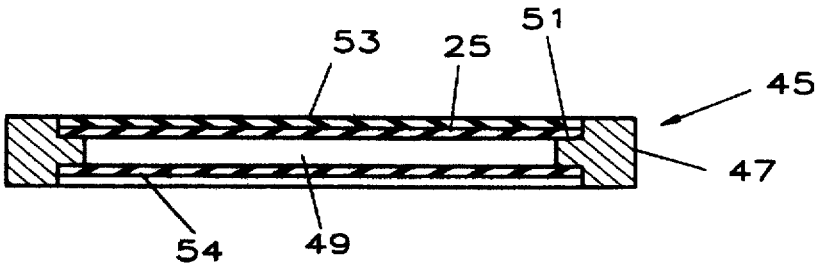
FIG. 9 is a cross-sectional view taken along line 8—8 in FIG. 8.
Figure 10:
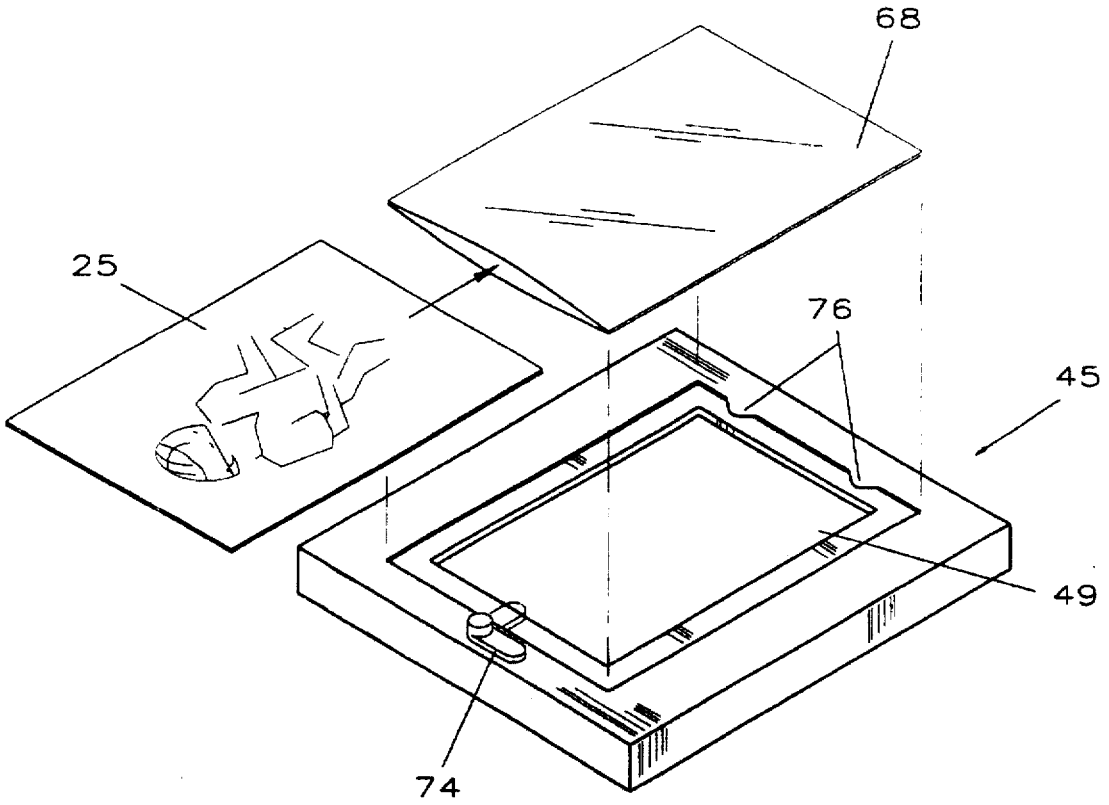
FIG. 10 is an exploded view of one plate of a another embodiment of a card holder in accordance with the present invention.

Holes 28a, 29a are rectangular and about the same size as card 25, though the holes could be smaller or larger as desired. A transparent sheet 36a, 37a of plastic (or glass) is provided over each hole 28a, 29a in order to cover and protect card 25. In the preferred construction, sheets 36a, 37a are mounted within recesses 38a, 39a formed in walls 21a, 22a about holes 28a, 29a. As shown in FIGS. 2 and 4, recess 38a is formed in front face 15a as a rectangular shaped border about hole 28a. Similarly, recess 39a is formed in the inner face 42a of rear wall 22a about hole 29a. Sheets 36a, 37a are preferably secured in recesses 38a, 39a, respectively, by adhesive, although fasteners, clips, or stops could also be used. In addition, a number of alterations could be in this construction. For instance, recesses 38a, 39a could be formed along either face 41a, 42a of walls 21a, 22a, respectively. Further, recesses 38a, 39a and sheets 36a, 37a could be omitted and holes 28a, 29a left open, if desired. If holes 28a, 29a are left open, the holes are formed to be smaller than card 25 to prevent loss of the card. As a further alternative, the plates could be formed as a single molded member, without holes and sheets, if composed as of a transparent plastic material.

Plate 12b has essentially the same construction as plate 12a, except that plate 12b is provided with oval openings 28b, 29b. While rectangular recesses 38b, 39b and rectangular sheets 36b, 37b could be used (FIG. 7), oval shaped plates and recesses are preferred. If desired, plate 12b could be manufactured as a simple block which does not receive a card. The block could include advertising indicia which could interact with the straps as discussed below.

As an alternative, cards 25 could be sealed within plates 12a, 12b. Cards which have not been removed from their packaging are generally of greater value than the same cards which have been so removed. In this construction, cards 25 are placed in slots 24a, 24b and open ends 26a, 26b are sealed during manufacture of card holder 10. The seal can be a tape 23 which could be slit or removed to permit removal of the card if desired, or could be a permanent seal (e.g., a fused plug) which could not be removed without damaging the card holder itself. Further, by using certain tapes or frangible closures, the seals could be fixed so that removal of the cards could not be effected without visible signs of tampering. The end of the slot could also be closed with a hinged lid (not shown) which could prevent inadvertent removal of the cards from the plates.

The plates could be formed with a number of different constructions which would receive cards 25 so that both faces could be viewed. For instance, plate 45 could be used in place of plate 12. Plate 45 has a marginal frame 47 that defines a central opening 49 which extends entirely through the plate. A peripheral shoulder 51 extends inwardly into opening 49 to form a stop. A card 25, placed against shoulder 51, is covered by a transparent sheet 53, 54 along each of its faces 33, 34. Sheets 53, 54 can be secured by adhesives, clips, staples or other means.

Alternatively, card 25 can be first placed within a transparent case 68. Case 68 may be a thin envelope or a slightly larger box member (not shown). In any event, case 68 is set within opening 49' of plate 45'. A pivotal arm 74 and nubs 76 are provided to secure case 68 in opening 49'. Nevertheless, case 68 could be secured in opening 49' in other ways, such as by friction or a series of nubs or other stops.

A plurality of straps or ribbons 80 are provided to movably interconnect plates 12a, 12b (or plates of any other construction). Each strap 80 includes a pair of opposite ends 82, 83 secured to the plates, and an unattached elongate medial portion 84. More specifically, card holder 10 includes two sets of straps 8Oa, 8Ob. One set of straps 80a overlies one plate 12a, while the other set 80b overlies the other plate 12b. Nevertheless, as discussed below, manipulation of plates 12a, 12b can reorient straps 80a to overlie plate 12b and straps 80b to overlie plate 12a.

As shown in FIG. 1, plates 12a, 12b are laid on a support surface in a juxtaposed relation with second side edge 18a and first side edge 17b in opposed face-to-face position. Of course, the plates could be free-standing in the same arrangement if desired. In any event, ends 82a of straps 80a are fixedly secured to first side edge 17a of plate 12a. Ends 83a of straps 80a are fixedly secured to first side edge 17b of plate 12b. Medial portion 84a overlies rear face 16a of plate 12a. Likewise, ends 82b of straps 80b are fixedly secured to second side edge 18a of plate 12a, and ends 83b are fixedly secured to second side edge 18b of plate 12b. Medial portion 84b overlies rear face 16b of plate 12b. As an alternative, ends 82, 83 of straps 80 can wrap around side edges 17, 18 and be secured to front faces 15a, 15b of plates 12a, 12b. The side edges 17, 18 of the plates 12 can also be provided with grooves (not shown) to receive straps 80a, 80b and ensure proper alignment with the proper questions or answers printed on card 25.

For the sake of explanation, the position illustrated in FIG. 1 is considered the first position. In this first position, straps 80a overlie the answers provided on rear face 34a of card 25a received into plate 12a. In this way, the questions on card 25a are positioned between each strap 80a and can be viewed through transparent sheet 37a. Since straps 80b are staggered relative to straps 80a, straps 80b in this first position overlie the questions 90 on card 25b. The answers 91 on card 25b are therefore visible between straps 80b. As an alternative, slots 24a, 24b could be formed at different depths so that the questions on both cards would be visible in this first position. This arrangement, however, causes the cards to be offset from one another.

To uncover the answers 91 on card 12a and the questions 90 on card 12b, one manipulates plates 12a, 12b to reorient straps 80a, 80b. Specifically, plate 12a is rotated or flipped in the direction of arrow 94 so that it lies on top of plate 12b. In this position, rear face 16a lies against rear face 16b. This position is considered the second position.

Plate 12a is then rotated or flipped again in the same direction, as indicated by arrow 95, so that it now lies on the opposite side of plate 12b. This orientation is considered the third position. In this third position, plates 12a, 12b again lie in a juxtaposed relationship. However, first side edge 17a and second side edge 18b are in opposed face-to-face relation, instead of second side edge 18a and first side edge 17b. This relative orientation could also be achieved by flipping plate 12b twice in the opposite direction.

As plate 12a is flipped from the second position to the third position, second side edge 18a of plate 12a is lifted from plate 12b. Accordingly, ends 82b of straps 80b are also lifted because they are secured to second side edge 18a. As can be appreciated, movement of straps 80b with plate 12a causes straps 80b to overlie rear face 16a of plate 12a. Since straps 80b are staggered relative to straps 80a, straps 80b overlie and obstruct questions 90 on card 25a and permit viewing of answers 91 between straps 80b. Similarly, in the third position, straps 80a now overlie the answers 91 on card 25b and permit viewing of questions 90 between straps 80a. This manipulation of plates 12a, 12b gives the appearance of flipping the cards, instead of reorienting of the straps, for added amusement of the game.

As an alternative, each rear face 34a, 34b of cards 25a, 25b (or at least the portions provided with questions and answers 90, 91), can be provided with colored pattern 46 or each sheet 37a, 37b, can be provided with a colored (e.g., red) pattern 43 to prevent ordinary reading of the questions and answers on cards 25a, 25b. The pattern could be a simple dot pattern, a pattern related to the nature of the card (e.g., baseball bats for baseball cards), or virtually any design. Straps 80a, 80b are composed of a transparent colored material (of the same color as the pattern). Straps could be made of polypropylene or of similar poly type material. With this construction, the colored pattern is absorbed by the color in the strap 32 so that the indicia underlying the straps can be read. The straps in this embodiment function to facilitate reading of the indicia instead of obstructing the indicia.

As one other alternative, one of the transparent sheets 36a, 36b, overlying card 25 or at least one side of case 68, could be formed of a transparent colored plastic sheet or colored acetone paper. In this construction, the cards have a colored pattern printed over at least the questions and answers to obscure their reading outside of the card holders. The straps, in this embodiment, are opaque to obstruct reading of the indicia underneath them.

Figure 11:
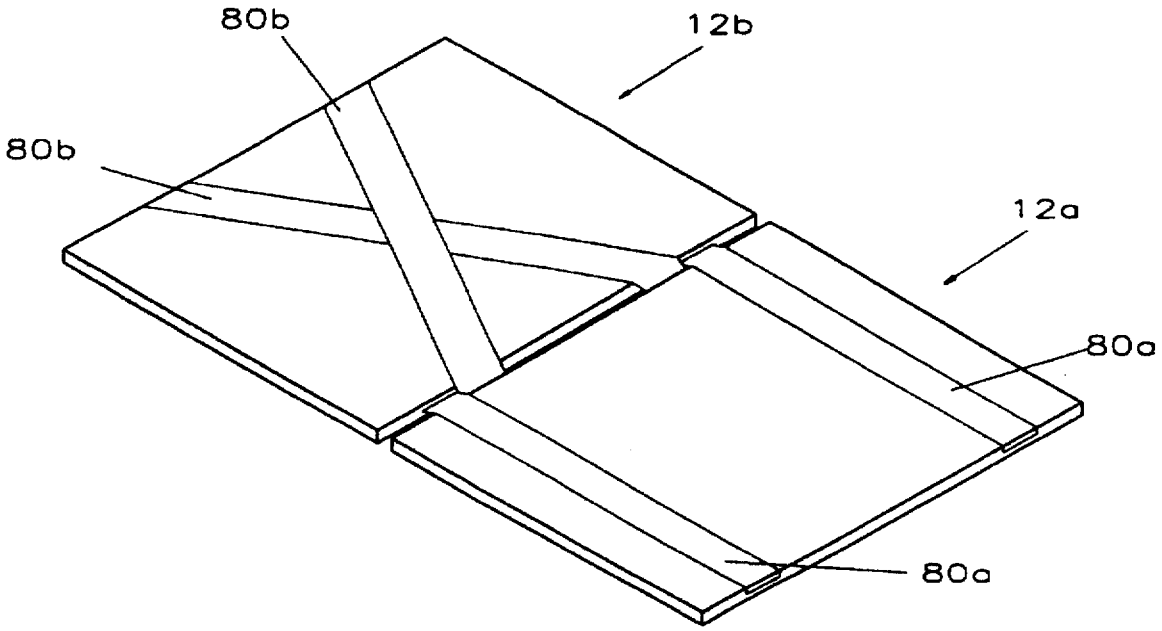
FIG. 11 is a perspective of an alternate card holder construction in accordance with the present invention showing only the interconnection of the straps with the plates.

In the preferred embodiment, the straps are parallel to one another and spaced apart an equal amount. Nevertheless, numerous variations could also be used. For instance, the spacing between the different adjacent straps could be different. Similarly, the widths of the straps could be varied relative to one another. Also, the straps could be used to cover only certain portions of the card, thus leaving other portions always exposed for pictures, facts, or other desired indicia. The straps 80a', 80b' can further be oriented in a non-parallel manner or even crossed if desired to provide a particular coverage of the cards 12a', 12b' (FIG. 11).

The plates could further be formed as a free-standing large scale display (i.e., with life size pictures on the cards). In this embodiment, the construction of the plates would be essentially the same as any of the plates discussed above. However, to lessen the risk of tipping, the plates are preferably weighted along the bottom edges, or provided with threaded holes or other fasteners for fixing the plates to the floor or other braces. The large scale version could be used to receive people, mannequins, or other three-dimensional objects as well as life size pictures. Such a large scale version, could be effectively used for advertising purposes.

The above-discussion concerns the preferred embodiments of the present invention. Various other embodiments as well as many changes and alterations may be made without departing from the spirit and broader aspects of the invention.

I claim:

1. A card device for receiving one or more cards, comprising:

at least two plates, each of said plates having a front face and a rear face, at least one of said plates having a mounting structure for receiving and supporting one of the cards, and means for permitting both faces of one of the cards to be viewed, said permitting means located on said at least one of said plates: and said card device having at least three straps interconnecting said plates, each of said straps having a pair of opposite ends attached to said plates and an unattached medial portion, said medial portion of at least one of said straps overlying one of said plates, and said medial portion of at least another said straps overlying the other of said plates, said plates being manipulable such that the medial portions of said straps can be reoriented to overlie the opposite plate; and wherein said means for permitting viewing of both faces of one of said cards includes an opening which extends through said front and rear faces.

2. A card device in accordance with claim 1, in which said opening is enclosed by a transparent sheet along each side of the card device.

3. A card device in accordance with claim 2, wherein said transparent sheet is provided with a colored pattern which is for obscuring indicia on the one or more cards, and wherein said straps are composed of a colored transparent material which absorbs the colored pattern and is for permitting the indicia on the one or more cards to be read.

4. A card device in accordance with claim 1, in which the at least three strays are spaced apart and are arranged to overlie each said plate, wherein said straps overlying one plate are offset relative to said straps overlying said other plate.

5. A card device in accordance with claim 1, in which at least two said straps are oriented in a non-parallel manner or crossed.

6. A card device in accordance with claim 1, in which at least one said plate has a means for holding only one of the one or more cards.

7. A card device in accordance with claim 1, in which at least one said plate has a means for loading and removal of the one or more cards through the front or rear face of said at least one plate.

8. A card device in accordance with claim 1, in which said mounting structure includes a slot which extends through said at least two plates.

9. A card device in accordance with claim 1, in which said mounting structure includes a opening with an inwardly extending shoulder.

10. A card device in accordance with claim 1, in which said mounting structure is sealed to prevent movement of the received card.

11. A card device in accordance with claim 10, in which said seal is fixed said seal cannot be opened without visible signs of tampering.

12. A card device including a card, said card having a front face and a rear face, said card device has means for receiving more than one card, said card with said front face having indicia, and said rear face having indicia, said card device comprising:

at least two plates, each of said plates having a front face and a rear face, at least one of said plates having a mounting structure receiving and supporting said card, and means for permitting both faces of the card to be viewed said permitting means located on said at least one of said plates; and having at least three straps interconnecting said plates, each of said straps having a pair of opposite ends attached to said plates and an unattached medial portion, said medial portion of at least one of said straps overlying one of said plates, and said medial portion of at least another of said straps overlying the other of said plates, said plates being manipulable such that the medial portions of said straps can be reoriented to overlie the opposite plate; and wherein said means for permitting viewing of both faces of the received card includes an opening which extends through said front and rear faces.

13. A card device including a card, in accordance with claim 12, wherein at least one said face of said card has an illustration that facilitates playing with the card.

14. A card device including a card, in accordance with claim 12, wherein at least one said face of said card has indicia that facilitates playing with the card.

15. A card device including a card, in accordance with claim 12, wherein at least one face of said card has indicia defining at least one question and at least one answer to the question.

16. A card device including a card, in accordance with claim 12, wherein at least one face of said card has indicia defining at least one question and another card having at least one answer.

17. A card device including a card, in accordance with claim 12, wherein at least one face of the card is provided with a colored pattern which obscures the indicia, and wherein said straps are composed of a colored transparent material which absorbs the colored pattern and permits the indicia on the card to be read.

18. A card device including a card, in accordance with claim 12, in which said opening is enclosed by a transparent sheet along at least one side of the card.

19. A card device including a card, in accordance with claim 18, wherein at least one face of the card is provided with a colored pattern which obscures the indicia, and wherein said transparent sheet is provided with a color and wherein said straps are composed of a colored transparent material, both said transparent sheet with a color and said straps of colored transparent material and said absorbs the colored pattern, on said card, and is for permitting the indicia on said card to be read.

20. A card device including a card, in accordance with claim 12, said plates being manipulable such that said straps can be reoriented to overlie the opposite plates and thereby reveal and cover portions on said card.

* * * * *